United States Patent [19]

Schimko

[11] 4,141,228

[45] Feb. 27, 1979

[54] PATTERN MECHANISM FOR A FLAT BED KNITTING MACHINE

[75] Inventor: Reinhold Schimko, Aalen-Wasseralfingen, Fed. Rep. of Germany

[73] Assignee: Universal Maschinenfabrik Dr. Rudolf Schieber KG, Westhausen, Fed. Rep. of Germany

[21] Appl. No.: 860,352

[22] Filed: Dec. 14, 1977

[30] Foreign Application Priority Data

Dec. 15, 1976 [DE] Fed. Rep. of Germany ..... 2656824

[51] Int. Cl.[2] ..... D04B 7/00

[52] U.S. Cl. ..... 66/75.1

[58] Field of Search ..... 66/75.1, 75.2, 154 A

[56] References Cited

U.S. PATENT DOCUMENTS

| | | | |
|---|---|---|---|
| 3,611,753 | 10/1971 | Krause | 66/75.2 |
| 3,715,897 | 2/1973 | Hadam | 66/75.2 |
| 3,717,014 | 2/1973 | Kohler | 66/75.2 |
| 3,955,381 | 5/1976 | Panchaud | 66/75.1 |

*Primary Examiner*—Ronald Feldbaum

*Attorney, Agent, or Firm*—Sughrue, Rothwell, Mion, Zinn and Macpeak

[57] ABSTRACT

A flat bed knitting machine with either a reciprocal or a rotatable carriage has a pattern mechanism in which needles are carried on a needle bed, each needle being operatively associated with a pattern sinker and a selection sinker having first and second parts, which parts can be connected together in a variety of relative positions. The rear portion of the first selector sinker part overlies the front portion of the second, and the connection is effected over these portions, the front portion of the first part being shaped so as to be depressible by the pattern sinker to permit the connection to be changed. The second selector sinker part has a butt or cam element operably engageable by cam means carried by the carriage and the first selector part has one or two such butts.

15 Claims, 8 Drawing Figures

PATTERN MECHANISM FOR A FLAT BED KNITTING MACHINE

BACKGROUND OF THE INVENTION

In knitting machine pattern mechanisms without Jacquard mechanisms, patterns are obtained by means of sinkers which extend rearwardly of the needles and are either of different lengths or provided with butts of different heights so that appropriate sinkers can be selected in accordance with a pattern. Both of these selection arrangements have the disadvantage that when a changeover to another pattern is to be made, the sinkers must be changed in position in the needle bed in accordance with the respective patterns. Moreover, it is usually then necessary also to shift the needles in order to be able to knit the required edge onto the piece of fabric, or to achieve further pattern possibilities by combinations between the sinkers and needles. This is particularly the case with different butt heights, because the pattern area is then very small.

Since this displacement of the needles and sinkers demands a considerable expenditure of effort it has been known to provide mechanisms for knitting machine in which the needle, or a part controlling the needle, is either raised or lowered, a selector member being associated with each needle which can be selectively adjusted to respective pressing bar rows in the cam in a number of stages. To achieve different knitting edges in for example 1:1, 2:1, or other kind of knitting, a number of rows of non-adjustable butts are provided on the selector members in accordance with a further proposal, the butts enabling the respective edge to be knitted by merely racking over the cam. With this kind of mechanism a considerable outlay is necessary for supporting the selector members and the needle bed must be very deeply slotted at the rear to enable the needle or a part controlling the needle to be raised and lowered to different depths.

It is accordingly an object of the invention to provide a pattern mechanism for a knitting machine which is of simple construction.

It is also an object of the invention to provide a pattern mechanism in which a needle control element is divided into two parts in order to facilitate pattern selection.

It is a further object of the invention to provide a pattern mechanism which facilitates selection of a wide range of patterns.

SUMMARY OF THE INVENTION

In accordance with the invention, each needle of the pattern mechanism is controlled by a pattern sinker element controlled in turn by a selector sinker element having a first part engageable with the pattern sinker element and a second part having means engageable by a cam, the two parts being adapted to be coupled together in a selected one of a plurality of relative positions.

In the mechanism of the invention the cam engageable means or butt of the second selector sinker part can be moved into different courses of the pattern running in a direction longitudinally of the needle bed, in which it is engaged by an associated cam element on the passage of the carriage.

Advantageously, the connection means between the two selector sinker parts comprises a plurality of notches in the second selector sinker part corresponding to the different positions of the butt of this second part. On the first selector sinker part, a dog may be provided, which can engage in the notches. Six such notches are conveniently provided in the second selector sinker part.

The notches in the second part may be equally spaced apart, and two dogs can be provided on the first part. This has the advantage of ensuring secure location for most positions of engagement.

Advantageously, the first selector sinker part is provided with one or two butts for engagement by cam elements. By an appropriate succession of first parts without any butt, with one butt, and with two butts, and independently of the possibility of adjustment of the pattern, different knitting edges in 1:1, 2:1 for example can thereby be knitted for the whole of the piece of fabric, merely by insertion of the first parts of the selector sinkers and by traverse of the associated cam means.

The pattern sinker and selector sinker are advantageously so constructed that one end of the first part of the selector sinker has at one end an elongated nose for engaging underneath a shank of the pattern sinker and lies at the other end on the second part of the selector sinker in the releasable connection therewith. The pattern sinker thus holds the first selector sinker part in the needle bed, whilst the first part of the selector sinker holds the second part of the selector sinker in the bed.

To prevent the selector sinker from being thrown rearwardly by the pattern sinker, a further butt may be provided on the first selector sinker part, for engagement by a cam element so that the pattern sinker is held back in the direction of motion of the needle. Again, a cover or retaining rail may be provided on the needle bed rearwardly of the butt of the second selector sinker part in such a position that the second selector sinker part is held securely in the needle bed if the first selector sinker part only just overlaps the second selector sinker part.

The front end of the elongated nose of the first part of the selector sinker is advantageously bevelled or tapered away from the bottom of the needle track. If then the bevelled part of the nose is brought under the butt of the pattern sinker and pressure is exerted on this butt, the first part of selector sinker can be swung up out of the needle bed or needle track.

Finally, a hook may be provided on the first part of the selector sinker which can engage in a groove of a slide which can be moved by hand across the needle bed. Through the engagement of the hook in this groove, which has a taper rising from the needle bed, the first part of the selector sinker may again be swung upwardly. By this construction, the adjustment of the two parts of the selector sinker with respect to one another is facilitated since the first part may be tilted without the position of the pattern sinker having to be altered.

The butts of the second parts of the selector sinker which have been set in relation to the first part of the selector sinker lie in parallel rows of the pattern along the needle bed, where they may be selected in accordance with the pattern by cam elements each associated with one course of the pattern. Advantageously cam elements are provided in the cam which overlie the selector sinker parts and which during the passage of the carriage effect that the parts of the selector sinker in their motion up to the needle and away from the needle remain securely connected.

Advantageously, in the case of flat bed knitting machines having carriages which run to and fro, the cam parts associated with the particular positions of the butts of the second parts of the selector sinkers can be racked out, half way, and in, into one of three positions at the reversal positions. In the case of flat knitting machines having carriages which revolve, racking of the cam parts is effected at racking positions. In accordance with the pattern the cam parts may be selectively moved for stitch-formation, tuck loop formation, stitch-transfer or non-operation.

DETAILED DESCRIPTION OF PREFERRED EMBODIMENTS

Figure 1:
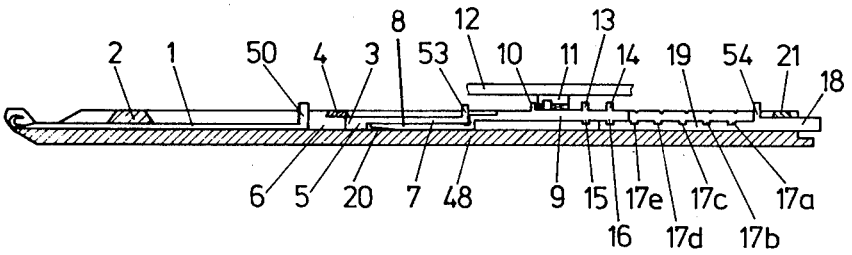
FIG. 1 is a cross-sectional side view through a needle bed showing a needle, a pattern sinker and a divided selector sinker as well as a cam part overlying the selector sinker, the second part of the selector sinker being shown in the rearmost position.
Figure 2:
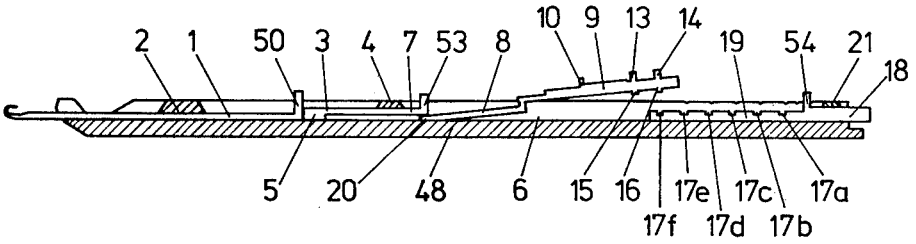
FIG. 2 is a view resembling that of FIG. 1 with the first part of the selector sinker raised.
Figure 3:
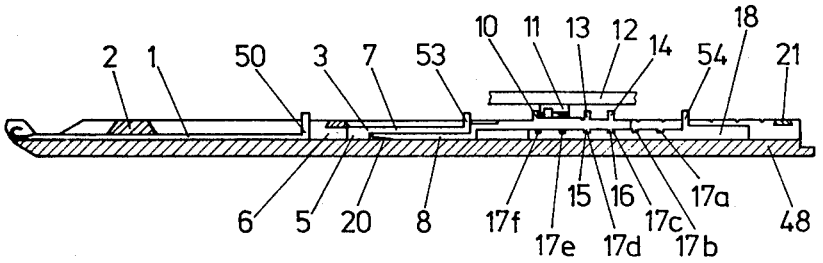
FIG. 3 is a view resembling that of FIG. 1 with the second part of the selector sinker offset forwards by four courses of the pattern.

In FIGS. 1 to 3 there is shown a needle bed 48 supporting a needle 1, a pattern sinker 3, and a selector sinker having two parts 9, 18, the bed being traversable by a carriage carrying cam means. The needle 1 is provided with a butt 50 and is guided by a cover-rail 2 extending along the needle board. Rearwardly of the needle 1 lies the pattern sinker 3, provided with a butt 53. which is slidable in the same plane. The pattern sinker 3 is guided by a cover-rail 4, also extending along the needle bed 48, and has a thickened front portion 5 which runs on the bottom of a needle track 6. The pattern sinker 3 is supported by a shank 7 on an elongated nose 8 projecting from the front of the first part 9 of the two-part selector sinker comprising also the second part 18. The first part 9 is provided with a butt 10 arranged to be engaged by a cam element 11 during a passage of the carriage in such a way that the selector sinker, or the first part thereof, is prevented from being thrown rearwardly by the pattern sinker 3. The cam element 11 is carried by a cam plate 12 through which it is guided by the carriage to move to and fro in a direction across the needle bed 48. The cam part 11 moreover overlies the first selector sinker part 9 so that the selector sinker is held securely in the needle track 6 during the passage of the carriage.

The selector sinker first part 9 may be provided as shown with two butts 13 and 14, or with one only of these butts, or with no butt at all. Depending upon the construction of the first parts 9 of the selector sinkers in this respect, different permanently predetermined patterns are set up for the knitting operation.

Two dogs 15 and 16 are provided on the underside of the first selector sinker part 9. At least one of the dogs 15 and 16 can be received in notches 17*a* to 17*f* in the rear part 18 of the selector sinker, when the first part 9 bears down a shank 19 of this second part.

The second selector sinker part 18 can move in the same plane as the needle 1, the thickened front part 5 of the pattern sinker 3, and the elongated nose 8 of the first part 9, that is, along the bottom of the needle track 6. The needle bed 48 may therefore be produced very simply.

The second part 18 is provided with a butt 54 which is spaced from the butt 14 of the first selector sinker part 9 by different distances depending on the position of engagement of the dogs 15 and 16 in the notches 17*a* to 17*f*. Accordingly, the butt 54 may be engaged by different parts of the cam in dependence on this spacing.

At the rear end of the needle bed, a further cover-rail 21 extending in the longitudinal direction of the needle bed 48 is provided, which holds the second selector sinker part 18 against movement upwards out of the needle bed 48, at least when only the dog 16 is caught in the notch 17*f*. This additional restraint is necessary because in this position, the first selector sinker part 9 provides a small restraining effect on the second part 18.

The selector sinker parts 9 and 18 may be relatively displaced in the following way. The elongated nose 8 of the first part 9 has at its front end a bevel or taper 20 extending towards that end away from the bottom of the needle track 6. If the pattern sinker 3 is slid far enough forwards for its butt 53 to lie on the nose 8 above the taper 20, as shown in FIG. 2, the first part 9 may be swung so that its rear part comes out of the needle bed 48 by pressure on the butt 53. In this event, if the dog 16 is caught in the notch 17*f* in the second part 18, for example, as shown in FIG. 1, the dog escapes from this notch and the first selector sinker part 9 is detached from the part 18. The part 18 may now be sufficiently displaced by means of its butt 54 in accordance with the pattern, for it to rest in the needle bed 48 in the course of the pattern associated with it, for example in the course *d* of the pattern as shown in FIG. 3.

Figure 6:
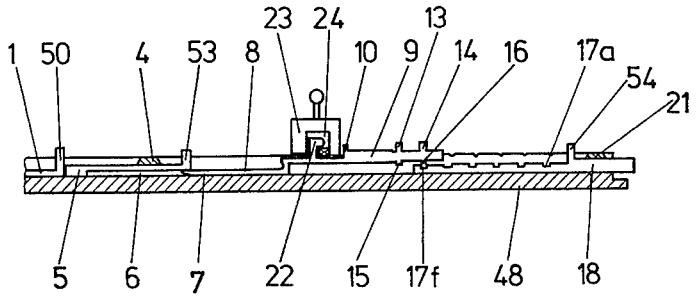
FIG. 6 is a partial view resembling that of FIG. 1 of a needle bed with a modified form of selector sinker and a slide associated therewith.

FIG. 6 shows another possible means for effecting displacement of the first selector sinker part 9. Here, this first part 9 is provided with a hook 22 which can engage in a groove 24 in a slide 23 movable by hand across the needle bed 48. One side face of the groove 24 runs obliquely upwards from the surface of the needle bed 48 so that a movement of the slide 23 in the direction of motion of the carriage causes the first part 9 to be swung above the needle bed.

Figure 4:
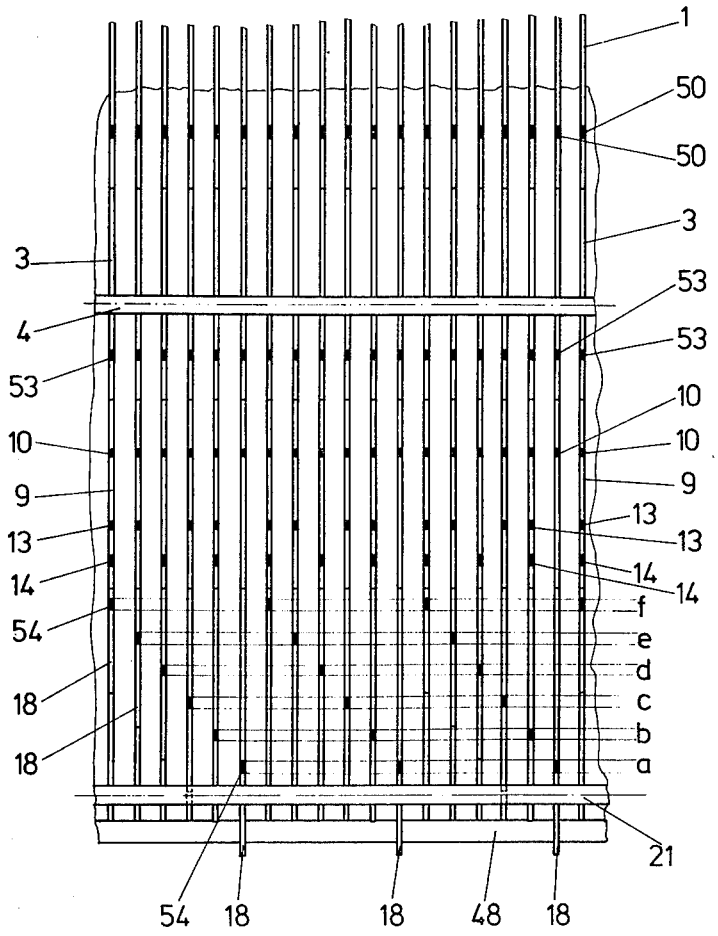
FIG. 4 is a plan of a portion of the needle bed with the butts of the second parts of the selector sinkers arranged in six courses of the pattern.

FIG. 4 is a plan view of a portion of the needle bed, in which the second parts 18 of adjacent selector sinkers are engaged in the first parts 9 in such a manner that the butts 54 lying in courses *a* to *f* of the pattern form diagonal rows. An arrangement like this is exceptional. In the large majority of patterns, the butts 54 lie irregularly in the courses *a* to *f* of the pattern.

Figure 5:
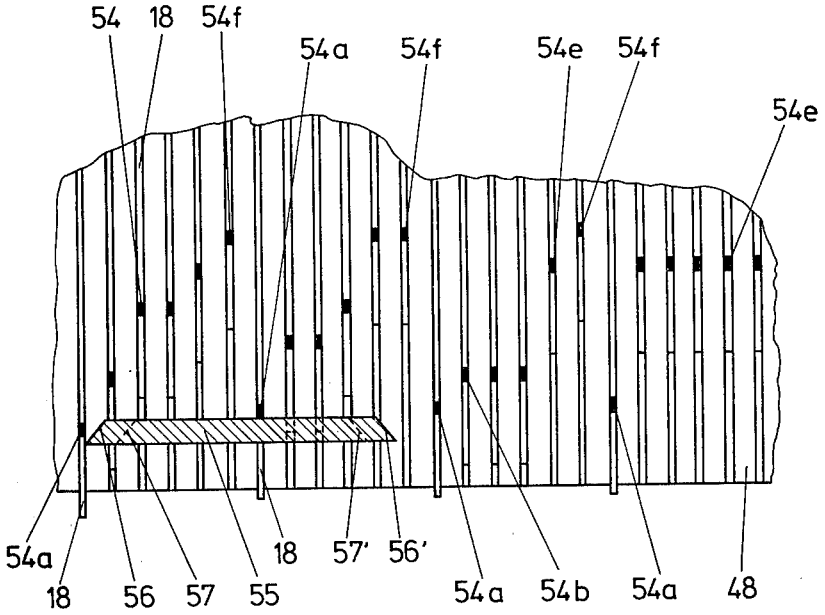
FIG. 5 is a plan of a portion of the needle bed with the butts of the second parts of the selector sinkers lying in different positions irregularly, a lifting cam element for the butts lying in one course of the pattern being shown in cross-section.

An irregular arrangement of the more usual kind is illustrated in FIG. 5. In addition, FIG. 5 shows a cam element 55 in section, just after it has slid parts 18 upwards by means of the butts marked 54*a*. With each of the courses *a* to *f* of the pattern, as also with the rows of butts 13 and 14, there is associated one such cam element 55. Depending upon whether the respective cam part 55 has been racked in, halfway out, at a racking point or at reversal of the carriage, it either moves the selector sinker forwards or not.

Figure 7:
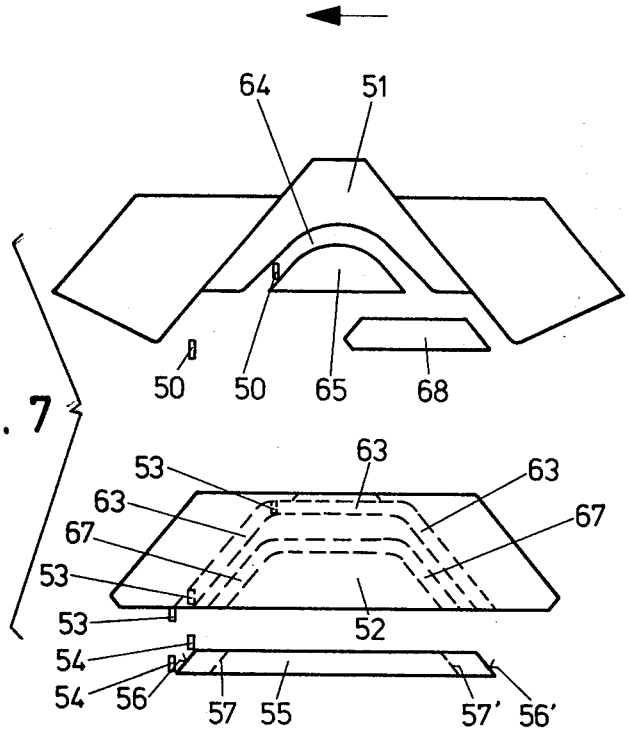
FIG. 7 is a diagrammatic plan view of a cam element of a cam with the cam element in the position for knitting stitches.
Figure 8:
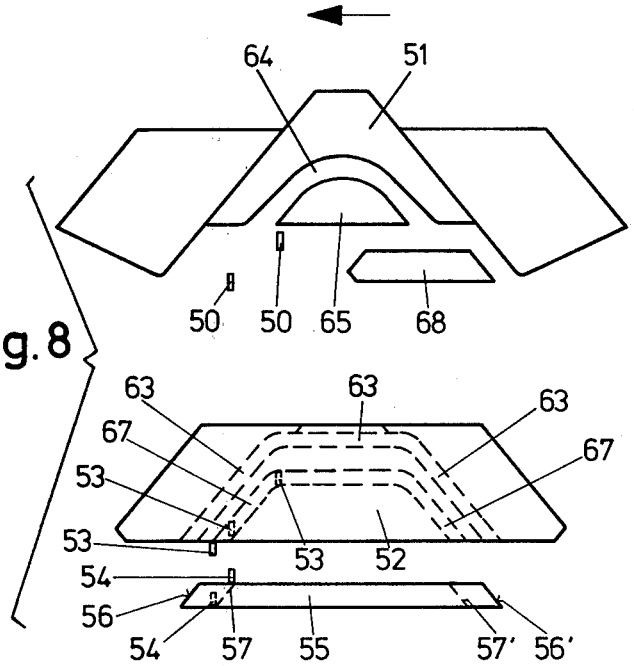
FIG. 8 is a view resembling that of FIG. 7 with the cam element in the position for forming tuck loops.

In FIGS. 7 and 8 the operation of cams in the selection of the pattern is diagrammatically shown. One cam element 55 is associated with each course *a* to *f* of the pattern, so that in the example illustrated six cam elements 55 lie under one another. Each of these cam elements 55 may be racked into three positions in the directions towards and away from the needle bed 48. In the case of flat bar knitting machines having carriages which run to and fro this is done at the point of reversal; in the case of flat knitting machines having carriages which revolved, and of circular knitting machines, it is done at racking points.

If the cam element 55 is moved into the top position, it slides past over the butts 53 of the second selector sinker parts 18 and leaves these lying in their normal position. If the cam element 55 is racked into its halfway position as shown in FIG. 8 it engages the butts 54 lying in the associated course of the pattern by its bevelled edges 57 or 57'. In the fully racked-in state as shown in FIG. 7, the cam element 55 seizes the butts 54 in the associated course of the pattern by its bevelled edge 56 or 56'. In this event, the selector sinker slides the butt 53 of the pattern sinker 3 into a channel 63 in a pattern cam 52. Here the pattern sinker is driven upwards and at the same time slides the needle 5 with its butt 50 to a level such that the latter is seized by a needle lifter 64 and runs through a channel 64 in the associated needle cam 51. Each of the needles 1 so selected forms a stitch. In each case, a cam part 68 is racked out of the way beforehand.

If instead the butt 54 of one selector sinker part 18 is seized by the bevelled edge 57, as shown in FIG. 8, the selector sinker slides the pattern sinker 3 with its butt 53 into a channel 67 in the pattern cam 52. The pattern sinker is driven upwards in this channel 67 and at the same time slides the needle 1 with its butt 50 under the needle lifter 65, so that a tuck loop is formed.

It is evident that the foregoing disclosure will enable those skilled in the art to make numerous other uses and modifications of, and departures from the embodiments specifically described herein without departing from the spirit and scope of the present inventive concepts. The present invention is to be construed as embracing each and every novel feature and novel combination of features herein disclosed and as being limited solely by the scope and spirit of the appended claims.

I claim:

1. In a knitting machine, a pattern mechanism comprising support means, a plurality of needles movably carried by said support means, a plurality of pattern elements carried by said support means, each of said pattern elements being operatively associated with a respective one of said needles, a plurality of first selector elements carried by said support means, each of said first selector elements being operatively associated with a respective one of said pattern elements, a plurality of second selector elements carried by said support means, connection means for establishing selectively adjustable connection between each of said first selector elements and a respective one of said second selector elements, a cam element on each of said second selector elements, cam means adapted for operative engagement with said cam elements, means mounting said cam means for movement relative to said support means to effect said operative engagement with said cam elements, a hook means on each of said first selector elements, a slide member manually movable across the needle bed, and groove means formed in said slide member for operative engagement with said hook means.

2. The knitting machine of claim 1 wherein said connection means comprises projection means on one of said first and second selector elements, and recess means interengageable with said projection means on the other of said first and selector means.

3. The knitting machine of claim 1 wherein said connection means comprises a plurality of recesses provided in each of said second selector elements, each recess being associated with a respective different position of the cam element of the part, and at least one projection provided on the associated first selector element, each of said recesses being adapted to receive said projection therein.

4. The knitting machine of claim 3 wherein said second selector element has three or more of said recesses equally spaced apart and said first selector elements has two of said projections.

5. The knitting machine of claim 1 further comprising at least one cam element adapted for engagement by said cam means provided on each of said first selector elements.

6. The knitting machine of claim 5 wherein said first selector sinker element is provided with a further cam element engageable by said cam means to prevent displacement of the selector elements by the associated pattern element.

7. The knitting machine of claim 1 wherein each of said first selector elements has at one end thereof an elongated nose portion adapted for engagement with said pattern element and at the other end thereof a portion overlying the second selector element.

8. The knitting machine of claim 7 wherein said elongated nose portion has a free end portion tapered towards said free end away from the support means.

9. The knitting machine of claim 1 further comprising retaining means for retaining the second selector elements on said support means extends over the support means on the side of the cam elements on said second selector elements remote from the needles.

10. The knitting machine of claim 1 further comprising cam elements of said cam means for overlying the first and second selector elements.

11. In a flat bed knitting machine, a needle bed; a multiplicity of needle sets slidingly carried on said bed, each needle set comprising a needle, first butt means on said needle, an elongate pattern sinker extending rearwardly from said needle, second butt means on said pattern sinker, an elongate first selector sinker extending rearwardly from said pattern sinker, an elongate second selector sinker extending rearwardly from said first selector sinker, third butt means on said second selector sinker, and releasable connection means on the rear end portion of the first selector means and on the front end portion of the second selector means, said releasable connection means being adapted to connect said first and second sinker elements in a selected one of a plurality of different relative lengthwise positions; a carriage movable transversely of said needle sets, and cam means on said carriage, said cam means being selectively operably engageable with said first second and third butt means.

12. The knitting machine of claim 11 wherein, in each of said needle sets, the rear end of said pattern sinker and the front end of said first selector sinker are cooperatively shaped so that, in at least one relative position of the pattern and first selector sinkers, pressure on said second butt means causes the rear end portion of the first selection sinker to be disconnected from said second selector sinker.

13. The knitting machine of claim 11 further comprising slide means manually movable relative to said needle bed transversely of said needle sets, a cam groove formed in slide means, and cam follower means on each of said first selector sinkers, said cam groove being shaped for engagement with said cam followers to tilt the first selector sinkers to release said connection means during said transverse movement of said slide means.

14. The knitting machine of claim 11 wherein said carriage is movable reciprocally between reversal positions and said cam means comprises cam elements associated with particular positions of said third butt means, each of said cam elements being selectively movable into one of three positions in which said element is respectively fully out, halfway out, and fully in at said carriage reversal positions.

15. The knitting machine of claim 11 wherein said carriage is rotatably movable and said cam means comprise cam elements associated with the particular positions of said third butt means, each of said cam elements being movable at racking positions of the carriage into one of three positions respectively out, halfway and in.

* * * * *